US005386753A

United States Patent [19]

Baron et al.

[11] Patent Number: 5,386,753

[45] Date of Patent: Feb. 7, 1995

[54] TAB CUTTING

[75] Inventors: Michael P. Baron, Phoenix; John R. Harrison, Baltimore; William F. Ward, Jr., Cockeysville, all of Md.

[73] Assignee: Ward Holding Company, Inc., Wilmington, Del.

[21] Appl. No.: 62,784

[22] Filed: May 14, 1993

[51] Int. Cl.[6] ..... B26D 1/153

[52] U.S. Cl. ..... 83/335; 83/342; 83/596; 83/672; 493/64

[58] Field of Search ..... 83/342, 672, 335, 595, 83/596, 56, 370; 493/68, 69, 70, 64, 72

[56] References Cited

U.S. PATENT DOCUMENTS

| | | | |
|---|---|---|---|
| 436,341 | 9/1890 | Dumais | 83/342 |
| 3,540,357 | 11/1970 | Ward, Jr. | 493/365 |
| 3,614,572 | 10/1971 | Usher | 83/370 X |
| 3,837,249 | 9/1974 | Long et al. | 83/672 X |
| 3,901,114 | 8/1975 | Cage | 83/335 X |
| 4,725,261 | 2/1988 | Millard et al. | 493/82 |
| 4,951,540 | 8/1990 | Cross et al. | 83/695 X |
| 5,158,522 | 10/1992 | Cumming et al. | 493/71 X |

*Primary Examiner*—Kenneth E. Peterson
*Attorney, Agent, or Firm*—Edward D. C. Bartlett; Ronald B. Sherer

[57] ABSTRACT

Cross cuts for forming the ends of a tab on a sheet, for example a glue tab on a corrugated paperboard container blank, are performed by independent rotary cutter units. Each cutter unit has a spirally convoluted blade which, as it rotates, cuts progressively inwards from an outside edge of the sheet towards an opposite outside edge. As the sheet is conveyed along, a downstream cutter unit cuts the leading end of the tab, and an upstream cutter unit cuts the trailing end. After each cut, the cutter remains at rest with its blade in an inoperative position out of the path of any oncoming sheet. A sensor senses the next oncoming sheet and initiates the cutting via a computer. These rotary cutters mitigate skewing of the sheets while being cut.

12 Claims, 8 Drawing Sheets

TAB CUTTING

FIELD OF THE INVENTION

This invention relates generally to cutting tabs on sheets, and particularly relates to cutting glue tabs (also called stitch tabs) on container blanks, particularly container blanks of corrugated paperboard.

BACKGROUND OF THE INVENTION

When manufacturing container blanks from paperboard sheets, a glue or stitch tab may be formed at one end of the container blank. This is done in a rotary slotter section by performing slotting operations on the container blank and at the same time making transverse cuts at the ends of the tab using cross-cut knives. Examples of such slotting operations are disclosed in U.S. Pat. Nos. 3,540,357 and 4,725,261, and the use of cross-cut knives is also disclosed in U.S. Pat. No. 4,725,261.

One disadvantage found with using cross-cut knives is that for various reasons the cross-cut is not always a clean cut, so that scrap pieces inadvertently remain connected to the cut container blank by portions of uncut material. Another disadvantage is the need to periodically adjust the depth of cut of the cross-cut knife due to anvil wear and also change in board thickness.

SUMMARY OF THE INVENTION

The present invention is concerned with providing a new approach for making the cross-cuts when producing tabs.

It has been noticed that as a cross-cut, knife is set deeper, for example to compensate for wear of the resilient anvil cover against which the knife cuts, the container blank tends to become slightly skewed as it leaves the rotary slotter section. This is because the pitch diameter of the knife has increased with the deeper settings so causing one side of the sheet to be moved faster than the other side. It has been noticed that the blank may in this way be skewed through as much as 1½ degrees. Such skewing is a disadvantage for the accuracy of further downstream processing, for example gluing and folding.

A feature of the present invention is to replace the cross-cut knife by a rotary cutter. This has the advantage that the cutter does not need to cut against and so wear an anvil surface, and has the further advantage of mitigating skewing of the sheets while being cut.

Accordingly, there is provided by one aspect of the present invention an apparatus, for processing a sheet to be formed with a tab, comprising a cutter having a blade rotatable about an axis, a conveyor adjacent the cutter for conveying the sheet past the cutter, the blade having a cutting edge, and the cutting edge having a leading end and a trailing end with respect to rotation about the axis. The cutting edge increases in radial distance from the axis between the leading end and the trailing end, and the cutter upon rotation progressively makes a cut in the sheet starting at a side edge of the sheet and progressing towards an opposite side edge of the sheet to form a cut end of the tab being formed on the sheet.

Preferably, the cutting edge is spirally convoluted about said axis.

The blade may form part of a wall of a sleeve. The sleeve-may be tapered towards one end. In another embodiment, the blade forms a fin extending outwardly from said axis.

Preferably, there is provided control means for intermittently operating the motor to accelerate the cutter from rest, rotate the cutter at a constant speed for part of a revolution thereof, and then decelerate the cutter to rest.

The cutter may be disposed to one side of the conveyor. Preferably, the cutter is a self-contained unit including a drive motor for rotating the blade.

According to another aspect of the present invention, there is provided an apparatus, for processing a sheet to be formed with a flap, comprising means for conveying a sheet in a forward direction, and cutter means for progressively making a cut in the sheet starting at a side edge of the sheet and progressing towards an opposite side edge of the sheet as the sheet is being continuously conveyed in the forward direction to form a cut end of the tab being formed on the sheet. The cutter means is rotatable and a motor is drivingly connected to the cutter means. Control means is provided for operating the motor to rotationally accelerate the cutter means, rotate the cutter means through the sheet to make said cut, and then rotationally decelerate the cutter means.

The cutter means may have a cutting edge which defines a curve displaced from and passing partly around an axis of rotation of the cutter means, with the curve advancing along the axis and being progressively displaced further from the axis as the curve so advances along the axis.

According to yet another aspect of the present invention, there is provided an apparatus for forming tabs on sheets comprising a conveyor for conveying the sheets in a forward direction, first and second cutters rotatable about first and second axes, respectively, first and second motors drivingly connected to the first and second cutters, respectively, for independent rotation of the cutters, the cutters being spaced apart in the forward direction adjacent one side of the conveyor, and each cutter having a cutting edge curved about the respective axis of that cutter. Each cutter has an inoperative position in which the cutting edge is spaced from a passing sheet being conveyed by the conveyor, rotation of each cutter from the inoperative position bringing the cutting edge into engagement with an outside edge of the passing-sheet, further rotation of this cutter moving the cutting edge through the passing sheet in a direction transverse to the forward direction towards an opposite edge of the passing sheet to progressively cut one end of an edge tab being formed on the passing sheet, and further rotation of this cutter removing the cutting edge from the passing sheet. Means is provided for causing the first and second motors to be rotated in timed relationship to effect cutting of opposite ends of the edge tab respectively by the first and second cutters.

With any of the foregoing arrangements, a rotary slotter section may be located upstream of the cutter, cutting means or cutters, the rotary slotter section including at least one slotter blade for making a slot in each sheet adjacent at least one end of the tab.

The apparatus preferably includes a gluer/folder section with the cutter, cutting means or cutters being mounted in said gluer/folder section.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters in different figures indicate like parts.

DETAILED DESCRIPTION OF THE PREFERRED EMBODIMENTS

Figure 1:
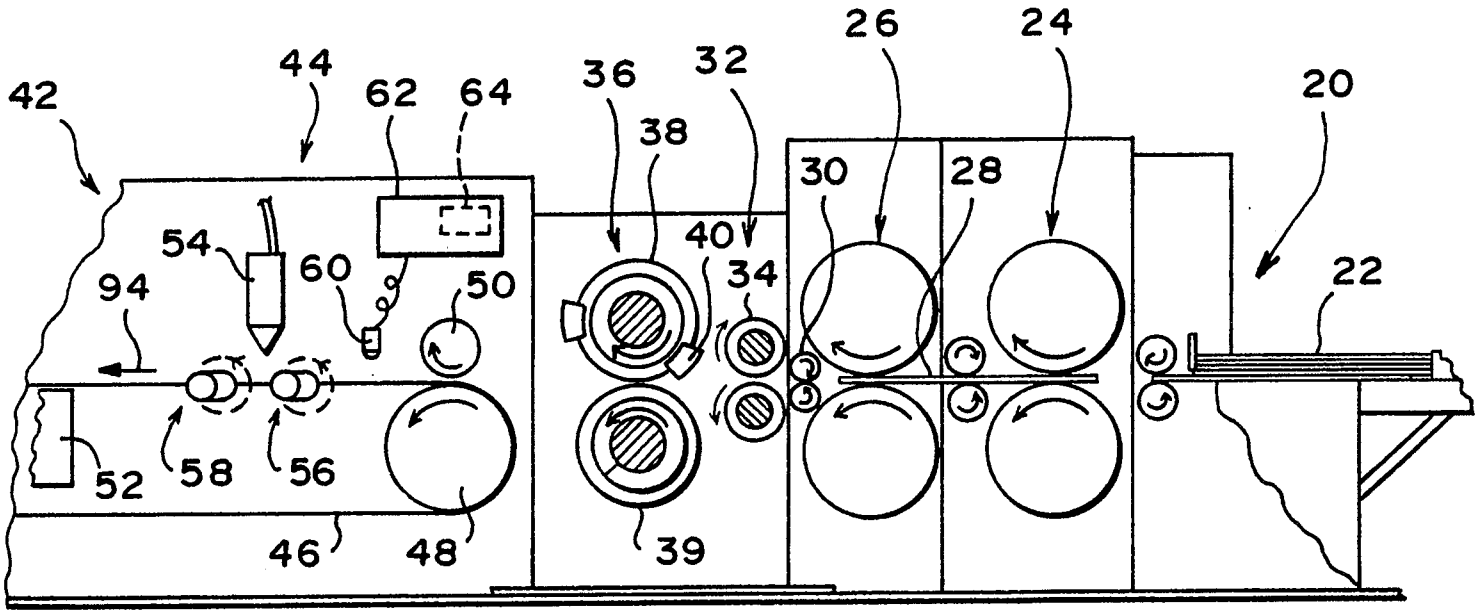
FIG. 1 is a simplified side elevational view of an apparatus according to the invention for processing sheets to form container blanks.

FIG. 1 shows a machine according to the invention for producing folded carton blanks from sheets of corrugated paperboard, the sheets being flexographically printed, creased, slotted, tab cut, glued, and folded. FIGS. 3 to 6 show a first embodiment of cutters for the tab cutting in FIG. 1, and FIGS. 7 to 14 show a second and preferred embodiment of cutters for the tab cutting in FIG. 1.

In FIG. 1, the container blank processing machine has a feed section 20 from which sheets are individually fed from a stack of sheets 22. The sheets are sequentially fed to a first flexographic printing section 24 and then to a second flexographic printing section 26, a container blank 28 being shown in the process of being printed by both sections. A pair of pressure rolls 30 feed the printed blank 28 into a creaser/slotter having a creasing section 32 with a pair of creasing rolls 34, and a slotting section 36 having a male slotter 38 and a female slotter roll 39. The male slotter roll 38 carries at one end two arcuately spaced apart slotter blades 40 for cutting slots adjacent each end of a glue tab being formed in the printed blank 28. From the slotter section 26, the blank 28 is passed into a gluer/folder section 42 commencing with a gluing station 44. An endless conveyor belt 46 passes over a pulley 48 and cooperates with an upper pressure roll 50 to grip the blank 28 and positively feed the blank downstream to the folder section which includes a vacuum box 52 for drawing the blank against the upper flight of the conveyor belt 46. In the gluing station 44, a glue extruder 54 applies glue partially along one end of the blank 28 for attachment of the glue tab when the blank is subsequently folded. Glue extruder 54 is on the far side of the machine as viewed in FIG. 1, with a pair of tab cutters 56, 58 on the near side of the machine as viewed in FIG. 1. The cutter 58 makes a cross cut to form the leading edge of the glue tab of the blank 28, and the upstream cutter 56 makes the cross cut forming the trailing end of the glue tab. A photo-electric sensor 60, just upstream from the first tab cutter 56, senses the leading edge of the blank 28 as it passes below the sensor 60. A signal is then sent from the sensor 60 to a computer 64 in a control unit 62. The computer 64 controls operation of the tab cutters 56, 58. According to the present invention, the two tab cutters 56, 58 are rotary cutters having profiled cutting blades designed to progressively make transverse cuts into the blank 28 as the blank continuously moves past these cutters 56, 58. The cutters 56, 58 are normally stationary in an inoperative dwell position, and their timing for operation to cut the ends of the glue tab is controlled via the computer 64. The cutters 56, 58 are supported on a subframe mounted on the frame of the gluer/folder at the location of the glue extruder 54 (except on the opposite side of the machine thereto).

Of course, other forms of glue applicators may be employed and, as desired, may be positioned on either side of the gluer/folder. For example, a glue wheel assembly may be employed on the operator side of the machine, i.e. the same side as the cutters 56, 58.

Figure 2:
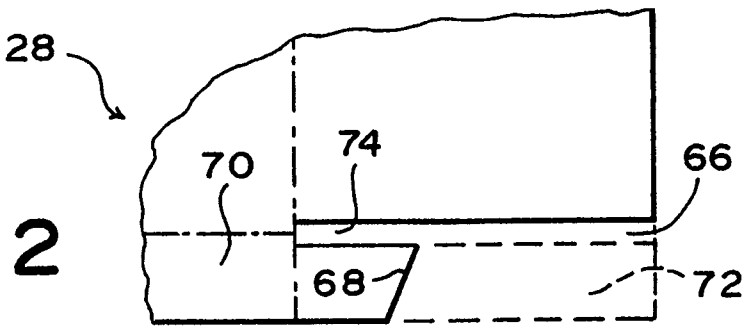
FIG. 2 is a plan view of a portion of a container blank showing one end of a glue tab cut with the apparatus of FIG. 1.

FIG. 2 shows a portion of a container blank after formation of the glue tab but before being folded. The blank 28 has had a rear slot 66 cut therein by the trailing slotter blade 40. An angled transverse cut 68 has been made by the upstream rotary cutter 56 from an edge of the blank 28 to the adjacent slot 66 so forming the rear end of the glue tab 70 and producing a piece of scrap 72 shown in broken lines. The cut 68 has been arranged partway along the slot 66 so that a portion 74 of the slot remains to define an extended glue tab. If desired, the cut 68 could be arranged at the lefthand end of the slot 66 so that the glue tab is formed without an extension. The forward end of the glue tab 70 is similarly formed by the leading slotter blade 40 and the downstream rotary cutter 58. The timing and sequence of operation of the rotary cutters 58, 56 depends upon the distance apart of the cutters 56, 58, the length of the glue tab 70 to be formed, and the linear speed at which the blank 28 is conveyed through the machine.

Figure 3:
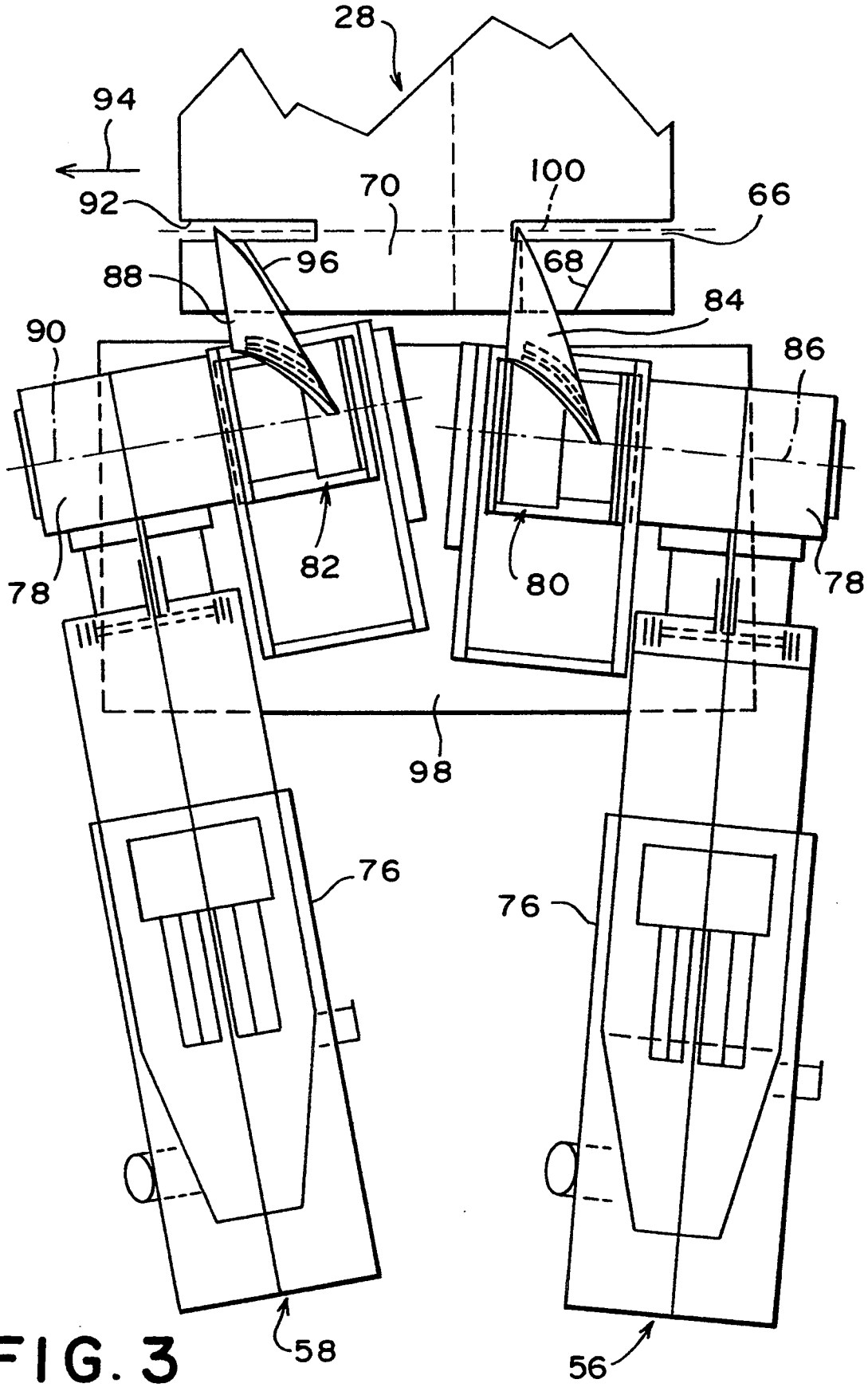
FIG. 3 is a plan view of a portion of the apparatus of FIG. 1 according to a first embodiment of the invention.

FIG. 3 shows in plan view a first embodiment of the rotary cutters 56, 58. In this embodiment, each cutter 56, 58 comprises a computer-controlled electric servo motor 76 having a right-angle reduction gear box 78 at the output end, the reduction ratio being 2:1. The two motors 76 are angled away from each other as shown in FIG. 3. The rear unit 56 has a rotary cutterhead 80 and the forward unit 58 has a rotary cutterhead 82, the cutterheads 80, 82 being angled towards each other. The cutterhead 80 has a fin-like profiled blade 84 and rotates about an axis 86. The cutterhead 82,has a fin-like blade 88 similarly profiled and rotatable about an axis 90. In the portion of the blank 28 shown, a forward slot 92 can be seen in addition to the rear slot 66. As the blank moves in the forward direction 94 past the cutters 56, 58, the blades 84, 88 as they rotate make rear and forward cuts along the lines 68, 96, respectively. As profiled in FIG. 3, the blades 84, 88 would rotate and cut upwardly through the blank 28, the blades rotating anti-clockwise about their respective axes 86, 90 when looking from right to left in FIG. 3. However, for easier control of cut scrap, it is preferred to rotate the blades downwardly through the blank by profiling the blades the opposite way round, as will be explained later with reference to FIG. 4. The two cutters 56, 58 are bolted onto a plate-like subframe 98 which is mounted on the frame of the gluer/folder on the operator's side thereof.

The lengths of the slots 66, 92 in the blank 28 are determined by the size and angular position of the slotter blades 40 (see FIG. 1). The depth of the tab 70 from the slots 66, 92 to the outside edge of the blank (the lower edge in FIG. 3) is determined by the positioning of the slots 66, 92 from the outside edge, with the blank 28 being fed past the cutters 56, 58 so that the center line of the slots 66, 92 is always on the same datum line 100.

The angling apart of the units 76 and the profiling of the blades 84, 88 determines the angles of the cuts 68, 96 forming the cut ends of the tab 70.

Figure 4:
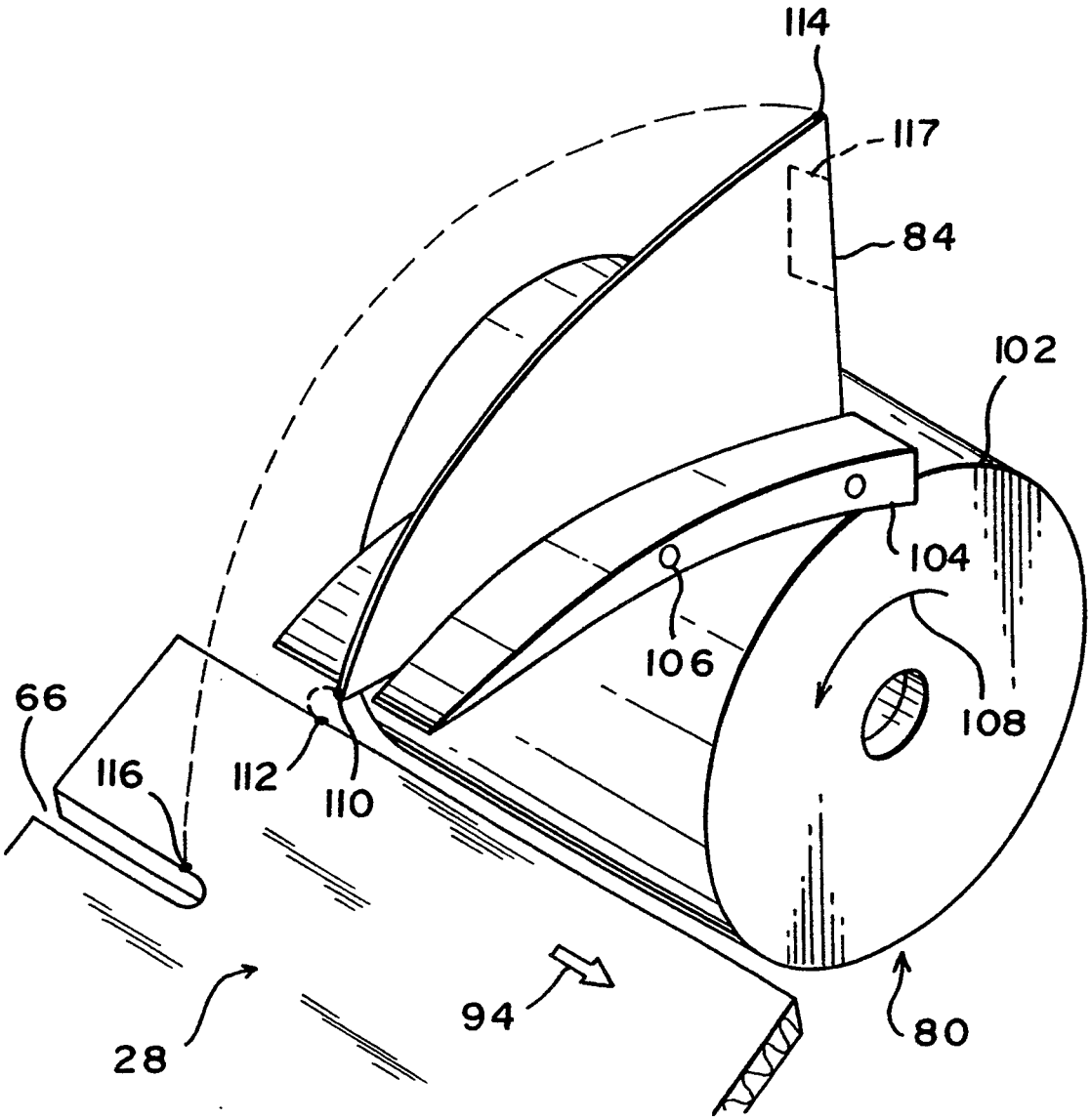
FIG. 4 is a perspective view of one of the rotary cutters in FIG. 3.

FIG. 4 shows a perspective view of the cutterhead 80 with the blade 84 profiled for downwardly cutting through the blank 28. The cutterhead 80 has a hub 102 with a slotted rib 104 formed helically around part of the cylindrical circumferential surface of the hub 102. The fin-like blade 84 is firmly held in the slot of the rib 104 by screws 106. The hub 102 is rotated in the direction of the arrow 108 (anti-clockwise as viewed in FIG. 4, but clockwise when viewed in FIG. 3 from right to left) until the leading end 110 of the blade enters the blank at a point 112 to commence the cut in the blank. As the blade 84 rotates, the cutting point of the blade progresses across the blank towards the slot 66 at the same time as this cutting point progresses with the blank in the direction of the arrow 94 at the same speed as the blank is moving. The trailing end 114 of the blade completes the end of the cut at a point 116 along the slot 66, the blade 84 continuing to rotate downwardly away from the blank and being brought to rest in an inoperative position out of the path of the blank 28. A kick down plate 117 is shown in broken lines extending perpendicularly from the blade 84 adjacent the trailing end of the blade. The kick down plate 117 is rivetted to the blade and extends away from the glue tab being cut. This kick down plate 117 strikes the piece of scrap (72 in FIG. 2) as this scrap piece is cut from the blank 28 to form one of the cut ends of the glue tab. The scrap piece is thereupon kicked downwards to the scrap conveyor below. Similar kick down plates can be attached to any of the rotary cutter blades of the present invention to more positively control removal of the cut scrap pieces.

Figure 5:
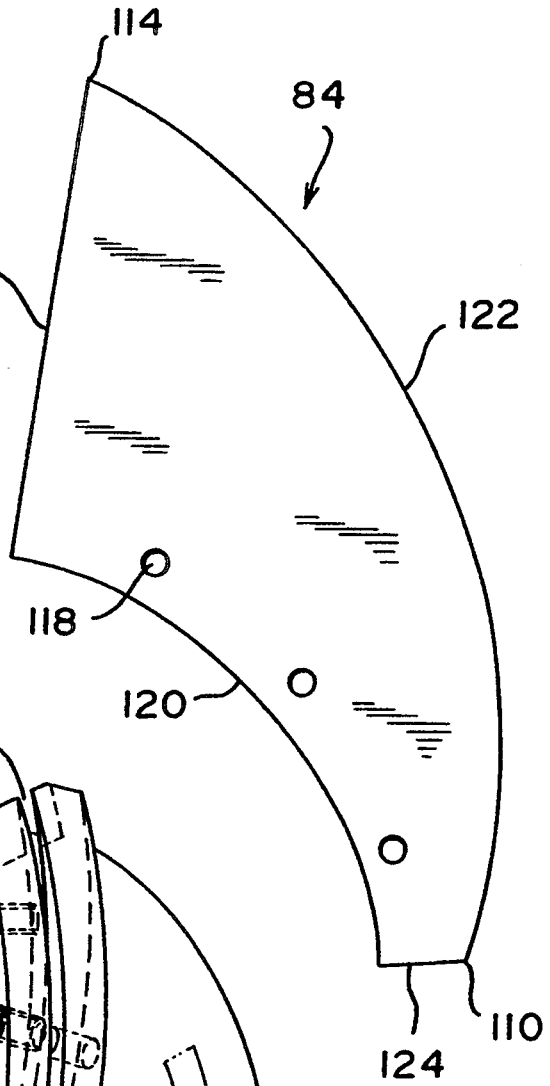
FIG. 5 is a plan view of the blade of the cutter of FIG. 4.

FIG. 5 shows a plan view of the blade 84 in its flat form before being flexed around the hub. The blade has three holes 118 adjacent its curved lower edge 120 for receiving the screws 106. The outer cutting edge 122 of the blade extends from a shorted leading edge 124 of the blade to a substantially longer trailing edge 126. In this way, the cutting edge 122 progressively increases in radial distance from the axis of rotation 86 (FIG. 3) of the blade as the cutting edge 122 progresses from the leading end 110 to the trailing end 114. Preferably, the blade 122 has outwardly extending radial slots each side of the holes 118 to more readily permit flexing of the blade when it is assembled on the hub.

Figure 6:
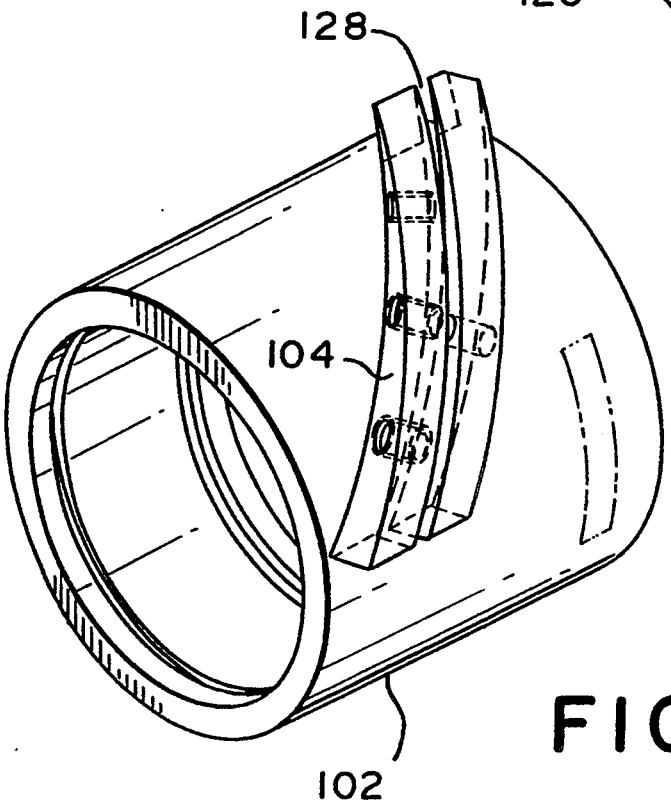
FIG. 6 is a perspective view of the hub of the cutter of FIG. 4, but showing the opposite end to that in FIG. 4.

FIG. 6 is a perspective view of the hub 102 showing the opposite end to that shown in FIG. 4. The helical groove 128 for receiving the blade 84 can be seen extending centrally of the rib 104 from one end to the other. Thus, when the blade 84 is assembled in the groove 128, as shown in FIG. 4, the base 120 of the blade follows a helical curve around a portion of the hub 102, while the outer cutting edge 122 of the blade progressively increases in radial distance from the axis of the hub 102 between the leading end 110 and the trailing end 114. In this way, the cutting edge 122 is spirally convoluted about the axis of the hub 102.

Figure 7:
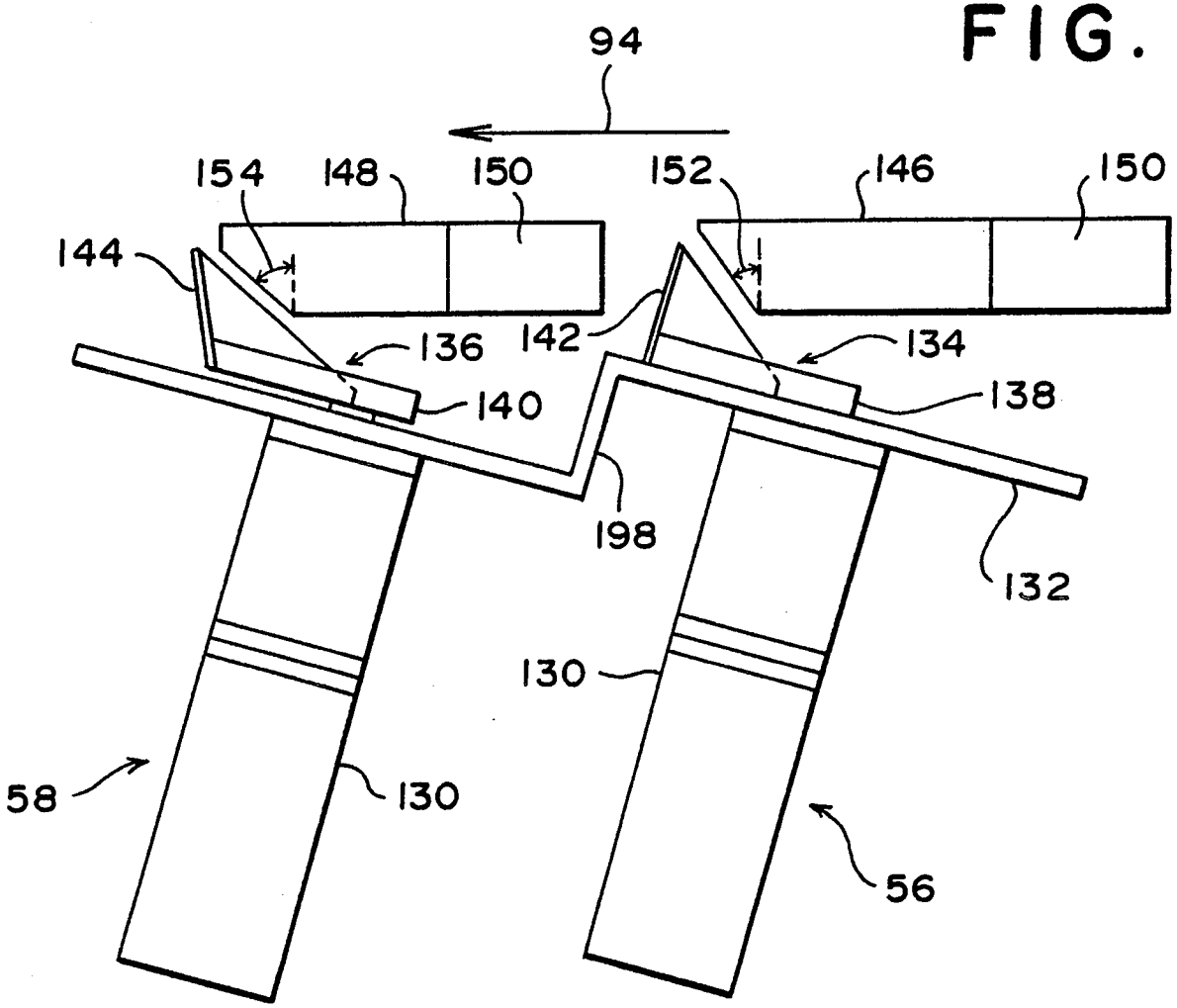
FIG. 7 is a simplified plan view, similar to FIG. 3, of a portion of FIG. 1 but showing a second embodiment of the invention.

FIG. 7 shows a second embodiment of the cutters 56, 58. Each cutter 56, 58 comprises a computer-controlled electric servo motor 130 mounted at its drive end in a subframe stepped bracket 132 and directly rotatably driving the respective cutterhead 134,136. The cutterhead 134 has an eccentrically formed hub 138, and the cutterhead 136 has an eccentrically formed hub 140. A cutting blade 142 in the form of a portion of a non-tapered sleeve is mounted on the hub 138, and a cutting blade 144 in the form of a portion of a tapered sleeve is mounted on the hub 140. The servo motors 130 are mounted parallel to each other so that the cutterheads 134, 136 have parallel axes of rotation. Support plates 146, 148 are disposed adjacent each cutterhead 134, 136, the support plates being located between the cutterhead hubs and the endless belt conveyor 46 (FIG. 1). The blanks pass over and in contact with the support plates 146, 148 and are so supported while being cut downwardly by the rotating blades 142, 144 as the sheets move at a constant speed in the direction of the arrow 94. The upstream end of each support 146, 148 is formed as an upwardly inclined ramp 150 to upwardly guide any down-turned leading end of a sheet. The downstream end of each support 146, 148 is formed transversely at an acute angle 152, 154, respectively, corresponding to the direction of cut of the blades 142, 144 as each blade rotates downwardly through the container blank and closely past the angled downstream end of the associated support plate. The cut progresses from an outer edge of the container blank adjacent the cutter and progressively moves towards the opposite edge of the container blank until the cut reaches the respective slot 66, 92 (FIG. 3) in the container blank. The angles 152, 154 depend upon the profile of the blades 142, 144.

The cutterhead 134 will now be described in greater detail with reference to FIGS. 8, 9 and 10, and the cutterhead 136 will then be described in greater detail with reference to FIGS. 11, 12 and 13.

Figure 8:
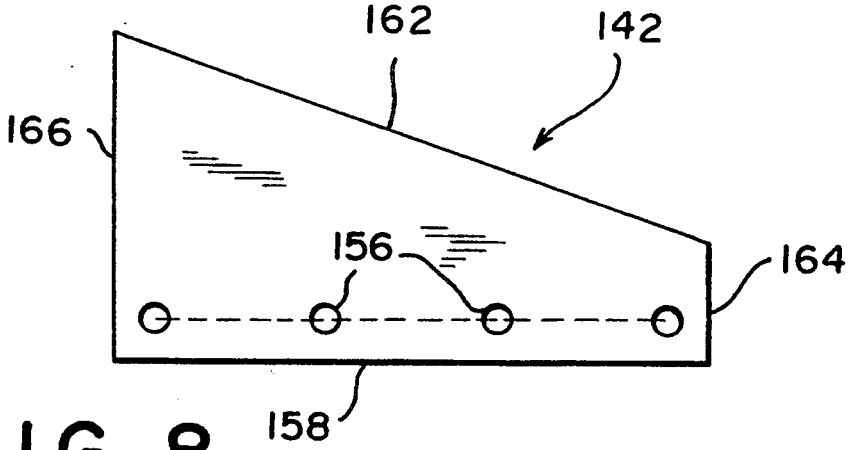
FIG. 8 is a plan view of the blade of one of the cutters in FIG. 7.
Figure 9:
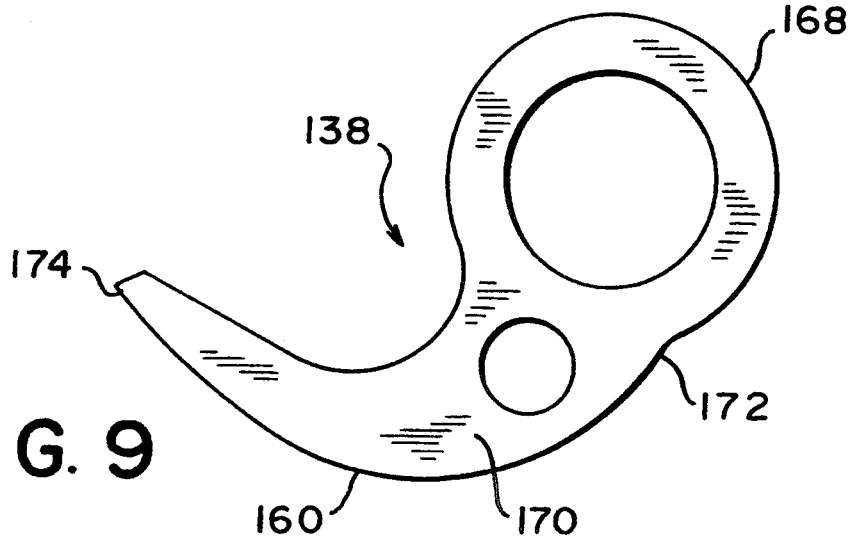
FIG. 9 is a plan view of a hub for the blade of FIG. 8.

FIG. 8 shows a plan view of the blade 142 of the cutterhead 134 before the blade is curved and assembled on the hub 138. The blade 142 has a series of holes 156 adjacent a base edge 158 for securing the blade by screws to an eccentric curved edge 160 of the hub 138. The cutting edge 162 of the blade 142 is, when the blade is flat, a straight line extending from a shorter front edge 164 to a longer rear edge 166. The hub 138 has a ring-like portion 168 which is mounted on the servo motor 130 concentric with the axis of rotation thereof. From the concentric portion 168 extends a curved eccentric leg portion 170, curving rearwardly of the direction of rotation of the hub 138 (the hub 138 being rotated counter-clockwise in FIG. 9). When the blade 142 is secured on the hub 138, the shorter leading edge 164 is positioned at an inner point 172 on the leg 170, and the longer trailing edge 166 is positioned at an outer point 174 adjacent the outer extremity of the leg 170. When the blade 142 is mounted along the curved edge 160, the blade extends downwardly from the plane of FIG. 9 and the cutting edge 162 extends from the far side of the hub 138 (i.e. the side facing the support plate 146 as shown in FIG. 7).

Figure 10:
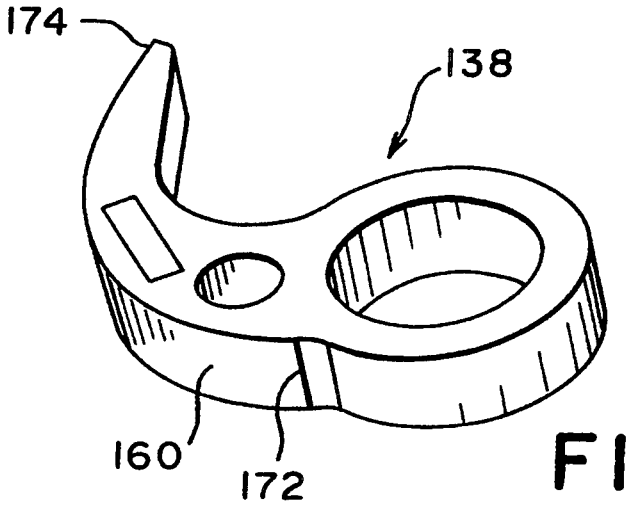
FIG. 10 is a perspective view of the hub of FIG. 9.

FIG. 10 shows a perspective view of the hub 138, and it should be noted that the curved edge 160, although eccentric to the axis of rotation of the hub, is parallel to the axis of rotation of the hub.

The edge 160, which is the leading edge of the hub 138 as it rotates, is convolutely curved with respect to the axis of rotation of the hub. Thus, the cutting blade 142, when assembled on the hub 138, has a convolutely curved cutting edge defining a curve which spirally advances around and along the axis of rotation as the curve is progressively displaced further from the axis of rotation. This enables a straight line cut to be made through the container blank as the container blank moves along at a constant speed.

Figure 11:
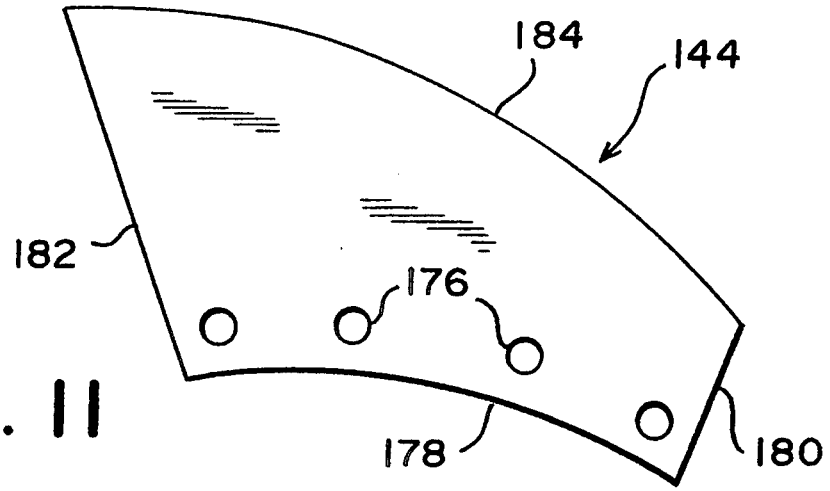
FIG. 11 is a plan view of the blade of the other cutter in FIG. 7.
Figure 12:
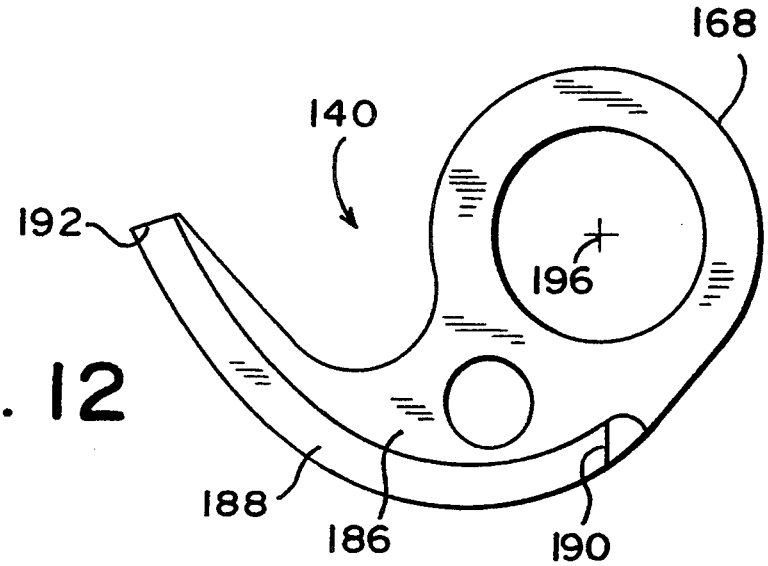
FIG. 12 is a plan view of the hub for the blade of Fig.11.
Figure 13:
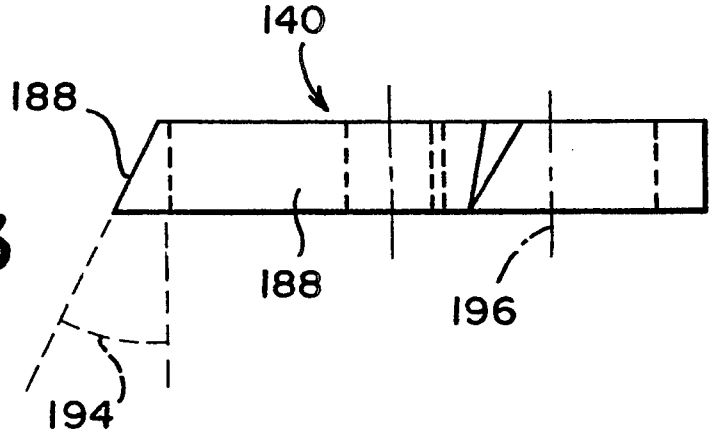
FIG. 13 is a side edge view of the hub of FIG. 12.

FIG. 11 shows in flat plan view the blade 144 of the rotary cutterhead 136, FIGS. 12 and 13 showing the hub 140 in plan view and front edge view. The blade 144 has four holes 176 spaced along its lower curved edge 178. An angled leading edge 180 is connected to a longer angled trailing edge 182 by a curved outer cutting edge 184. The hub 140 has a concentric portion 168 the same as in the hub 138 of FIG. 9, and also has an eccentrically curved leg 186 which is curved more sharply than the eccentric leg 160 of the hub 138. The leading edge 188 of the leg 186 is bevelled along its length from an inner end 190 to the outer end 192. As shown in FIG. 13, the bevelled surface 188 is inclined at an acute angle 194 to lines parallel to the rotational axis 196 of the hub 140. The blade 144 is secured to the hub 140 by screws inserted through the holes 176 into the bevelled edge 188 with the blade 144 extending downwardly through the plane of the paper in FIG. 12, the shorter front edge 180 being located at the inner end 190, and the longer trailing edge 182 being located at the outer end 192. Due to the shape of the blade 144 and the bevel of the edge 188, when the blade is secured to the hub the lower edge 178 is curved along the bevelled edge 188 with the blade 144 taking on the configuration of a portion of a wall of a tapered sleeve, as can be appreciated from FIG. 7. The bevelled leading edge 188 is convolutely curved with respect to the axis of rotation 196.

The cutting edge 184 is convolutely curved and defines a spiral which advances around and along, the axis 196 towards the carton blank as the curve progressively displaces further from the rotational axis 196. The circle defined by the trailing end of the cutting edge 184 has a larger diameter than the circle defined by the trailing end of the cutting edge 162 of the blade 142 of the upstream rotary cutter 134, this being indicated in broken lines in FIG. 1.

In an example of the embodiment of FIGS. 7 to 13, the angle 152 of the downstream end of the support plate 146 is 40 degrees, and the corresponding angle 154 of the downstream support plate 148 is 44 degrees. The angle 194 of the bevelled edge 188 is 30 degrees. The servo motors 130 are Indramat MAC 63 D servo motors having a peak torque of 89 inch pounds, an RMS peak torque of 31 inch pounds, and a maximum speed of 3500 rpm. These motors 130 have their rotational axes spaced 9 inches apart, and the step back 198 in the center of the subframe bracket 132 is 2½ inches. The trailing point of the cutting edge of the blade 142 defines a circle having a radius of 3.75 inches, and the trailing of the cutting edge of the blade 144 defines a circle having a radius of 4.5 inches. The cut ends of the glue tab are inclined at 15 degrees.

Figure 14:
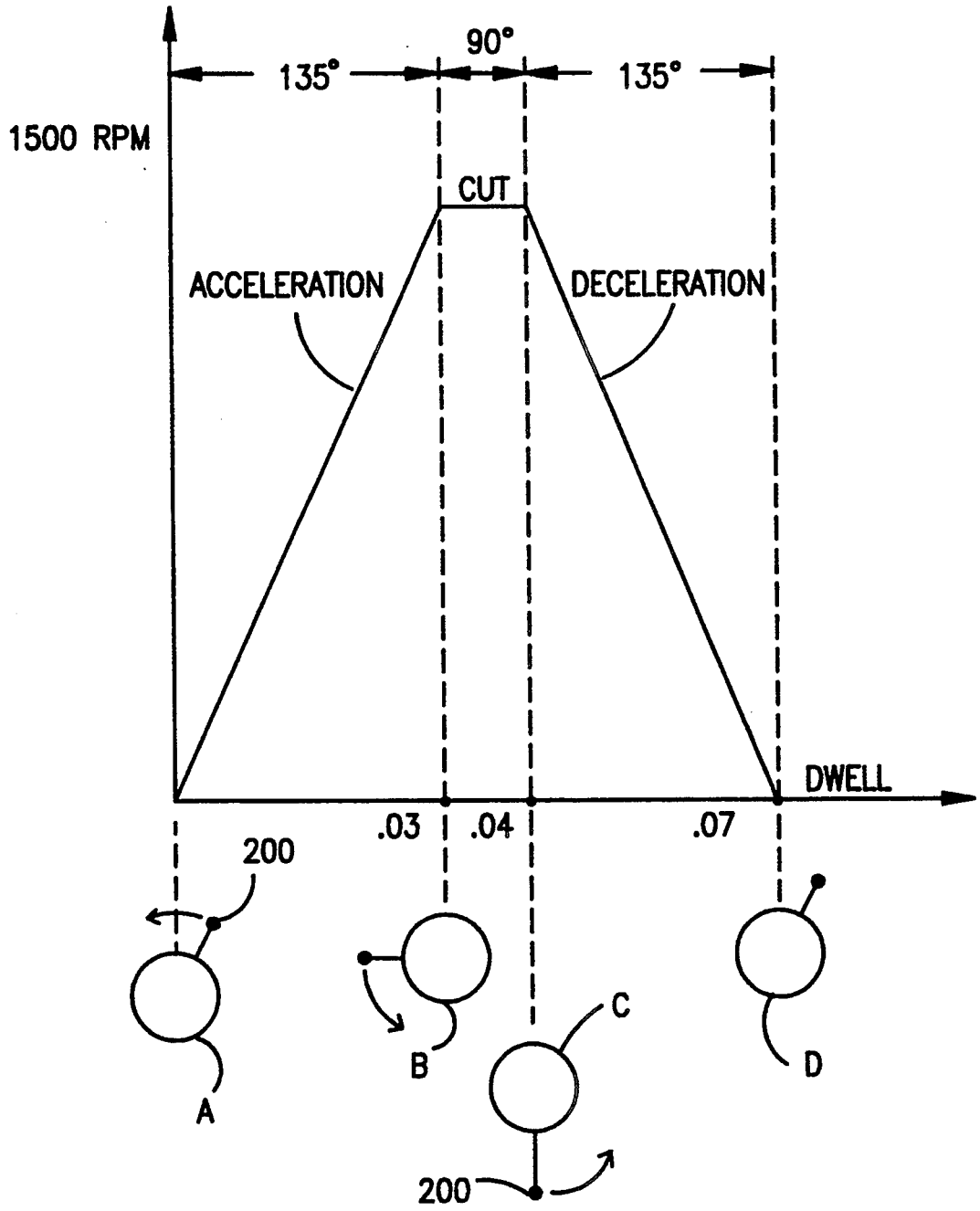
FIG. 14 is graph and representation of one cutting rotation of either cutter of FIG. 7.

FIG. 14 illustrates the operation of each of the cutting heads 134, 136 when rotated through a single revolution to make a cut through the container blank to form one cut end of the glue tab. The cutting heads are normally at rest in an inoperative position with the front edge of each cutting blade above the board line but with the blade completely out of the path of any oncoming container blanks. Under the control of the computer 64 (FIG. 1 ) for the correct timing and program, each cutting head is accelerated from rest to a cutting speed, rotated at that cutting speed while making the cut in the carton blank, and then decelerated to rest in the inoperative position again. In the graph of FIG. 14, the vertical axis represents revolutions per minute of the cutting head, and the horizontal axis represents time in seconds. As can be seen, in a complete cutting revolution of the cutting head, the acceleration occurs over the first 135 degrees of rotation in a period of 0.03 seconds; the actual cutting occurs over the next 90 degrees of rotation at constant speed and takes only 0.01 seconds; and then the deceleration occurs over the remaining 135 degrees of rotation and takes 0.03 seconds. Thus the complete revolution of the cutter from rest back to rest takes 0.07 seconds, with the cut being performed at 1500 rpm. At the bottom of FIG. 14, the position of the leading point 200 of the cutting blade 142, 144 is shown in relation to the acceleration, cut and deceleration portions of rotation. As depicted schematically, the cutter blade is being viewed from the bottom end of either servo motor 130 upwards in FIG. 7 towards the support bracket 132. Position A is the inoperative position, in which the cutter blade normally dwells and from which the cutting head starts to rotate in the direction of the arrow, with the leading point 200 of the cutting blade at a position 45 degrees before the vertical. The cutting head rotates anti-clockwise 135 degrees from position A to position B. The cut then occurs from position B to position C. Then the blade leaves the container blank and decelerates through the next 135 degrees back to the inoperative position in FIG. D where it dwells at rest until the next approaching sheet needs to be cut.

It will be noticed in FIG. 7 that by arranging the rotational axes of the cutterheads 134, 136 at an acute angle against the direction of travel 94 of the sheets, the cutting blades 142, 144 when in their inoperative positions are to the right sides (i.e. to the upstream sides) of the servo motors 130, and so are completely out of the path of any oncoming sheet approaching in the direction 94 on the conveyor belt 46.

The cutting heads 80, 82 of FIG. 3 operate similarly to the graph and representations of FIG. 14.

In operation, after each sheet 28 has been processed by the processing stations 24, 26, 32 and 36 in FIG. 1, the sheet is then fed by the pressure roll 50 and the conveyor belt 46 into the gluer/folder 42. As the leading edge of the sheet is detected by the sensor 60, the computer 64 times the start of rotation of the downstream cutterhead 58 to cut the leading end of the glue tab, and appropriately times the start of rotation of the upstream cutterhead 56 to cut the trailing end of the glue tab. A taco generator in one of the upstream processing sections provides the computer with the board speed, and the length of the glue tab is manually programmed into the computer 64. The computer 64 also programs the speed of rotation of the cutting heads so that during a cut the cutting point advances in the direction 94 at the same speed as the sheet being cut. By so synchronizing the speed of advance of the cutting point with the speed of board travel, it will be appreciated that the ends of the glue tab can be cut cleanly without skewing of the container blank.

The cutter blades are preferably twenty thousandths of an inch thick and made of stainless steel of cutter quality with the cutting edge being a double bevel edge and double sided. The blade may be coated with ceramic. It should be realized that although the blade cuts across the container blank towards and to one of the slots, the blade is making a type of plunge cut as it rotates.

The above described embodiments, of course, are not to be construed as limiting the breadth of the present invention. Modifications, and other alternative constructions, will be apparent which are within the spirit and scope of the invention as defined in the appended claims.

What is claimed is:

1. Apparatus for forming tabs on sheets, comprising:

a conveyor for conveying the sheets in a forward direction;

first and second cutters rotatable about first and second axes, respectively;

first and second motors drivingly connected to said first and second cutters, respectively, for independent rotation of said cutters;

said cutters being spaced apart in said forward direction adjacent one side of said conveyor;

each cutter having a cutting edge curved about the respective axis of that cutter;

each cutter having an inoperative position in which the cutting edge is spaced from a passing sheet being conveyed by said conveyor;

rotation of each cutter from the inoperative position bringing the cutting edge into engagement with an outside edge of the passing sheet, further rotation of said cutters moving the cutting edges through the passing sheet in a direction transverse to said forward direction towards an opposite edge of the passing sheet to progressively cut the ends of an edge tab being formed on the passing sheet, and further rotation of said cutters removing said cutting edges from the passing sheet;

means for causing said first and second motors to be rotated in timed relationship to effect cutting of opposite ends of said edge tab respectively by said first and second cutters, and a rotary slotter section located upstream of said cutters with respect to said forward direction, said rotary slotter section including two slotter blades for making slots in each sheet adjacent said opposite ends of said edge tab.

2. The apparatus of claim 1 wherein said cutters include blades, and said blades form parts of walls of sleeves.

3. The apparatus of claim 2 where in said sleeves are tapered toward their ends.

4. The apparatus of claim 1 wherein said cutters include blades, and said blades are in the form of partially spiral fins extending outwardly from their respective axes.

5. The apparatus of claim 1 including control means for intermittently operating said motors to accelerate said cutters from initial rest positions, then rotate said cutters at a constant speed for part of one revolution thereof, during which part revolution said tab is cut, and then decelerate said cutters to return to said initial rest positions.

6. A container blank processing machine for printing and otherwise processing paperboard container blanks comprising:

(a) conveyor means for conveying said container blanks through said machine in a forward direction, (b) at least one printing section for printing said container blanks as they are conveyed through said printing section, (c) a slotter section for cutting slots in said container blanks, said slots extending parallel to said forward direction and forming a tab along the edge of said container blanks, said tab having leading and trailing ends to be cut, (d) first and second cutter blades positioned at spaced locations along said forward direction for cutting said leading and trailing ends of said tab, (e) each of said cutter blades being rotatable about a respective axis and having a cutting edge convolutely curved about said respective axis for progressively making a cut in said blank starting at the edge of said blank and progressing toward said slots, said cutter blades having inoperative positions in which said cutting edges are located outside said path;

first and second motors drivingly connected to said cutter blades; and means for intermittently operating said motors to rotate said cutter blades from said inoperative positions, then through said blank to make said cuts while the blank is being conveyed along said path, and then return said cutter blades to said inoperative positions.

7. The container blank processing machine of claim 6, wherein said convolutely curved cutting edge defines a curve which spirally advances around and along said axis as the radius of said curve progressively increases from said axis.

8. The container blank processing machine of claim 6 wherein said cutting edge forms part of a spiral, and wherein said cutting edge extends about the respective axis substantially less than 180 degrees.

9. The container blank processing machine of claim 6 including control means for sequentially controlling said motors to first accelerate said cutter blades to a predetermined speed, then cut said tab ends at said predetermined speed, and then decelerate said cutter blades to rest positions.

10. The container blank processing machine of claim 9 wherein said acceleration, said cutting and said deceleration all occur during one revolution of said cutter blades, and wherein said acceleration and deceleration occur during the major portion of said one revolution and said cutting occurs during a minor portion of said one revolution.

11. The container blank processing machine of claim 10 wherein said minor portion of one revolution during which cutting occurs comprises substantially less than one second.

12. The container blank processing machine of claim 6 wherein the trailing end of one of said cutter blades extends a greater distance from the respective axis of that cutter blade than does the trailing end of the other of said cutter blades whereby the circle of rotation of one cutter blade is of larger diameter than that of the other cutter blade.

* * * * *